United States Patent [19]

Lenherr et al.

[11] 4,004,520

[45] Jan. 25, 1977

[54] TIME FUSE

[75] Inventors: Markus Lenherr, Geneva; Pierre Iseli, Petit-Lancy, both of Switzerland

[73] Assignee: Mefina S.A., Fribourg, Switzerland

[22] Filed: Mar. 28, 1974

[21] Appl. No.: 456,195

[30] Foreign Application Priority Data

Apr. 10, 1973 Switzerland ..... 5107/73

[52] U.S. Cl. ..... 102/78; 102/76 R

[51] Int. Cl.[2] ..... F42C 1/04; F42C 15/24

[58] Field of Search ..... 102/76, 78, 80

[56] References Cited

UNITED STATES PATENTS

| | | | |
|---|---|---|---|
| 2,701,527 | 2/1955 | Granath et al. | 102/80 X |
| 3,118,378 | 1/1964 | Jasse | 102/78 |
| 3,277,785 | 10/1961 | Clayton | 102/78 X |
| 3,339,488 | 9/1967 | Borchers | 102/78 |
| 3,390,637 | 7/1968 | Kent | 102/78 |
| 3,616,756 | 11/1971 | Simmen et al. | 102/76 |
| 3,814,018 | 2/1971 | Daniel | 102/78 |

*Primary Examiner*—Harold Tudor
*Attorney, Agent, or Firm*—Emory L. Groff, Jr.

[57] ABSTRACT

A time fuse for a non-spinning projectile has a pivoted catch connecting a fuse setting member to a setting disc whereby rotation of the member rotates the disc to wind a clockwork spring. A plunger is locked in a housing in the setting member by a movable ball or spring held by a spring-urged inertia block. When the fuse is set, the plunger acts on the catch to disconnect the disc and member upon displacement of the inertia block in response to axial acceleration of the projectile in a piece of ordnance.

1 Claim, 3 Drawing Figures

TIME FUSE

The invention relates to time fuses for projectiles.

U.S. Pat. No. 3,616,756 describes a time fuse, suitable for a non-spinning projectile, incorporating means for making the projectile transport safe, bore safe and trajectory safe arranged to hold a primer charge carried by a movable support out of its operative position during a predetermined time after the projectile has been shot, by means of a clockwork including an escapement mechanism which also controls freeing of a spring-loaded firing pin to detonate the projectile. A fuse setting member movable angularly with respect to a body of the fuse is adapted to drive a fuse setting disc rotationally rigid with a spindle subjected to the torque of the clockwork drive spring.

The fuse further comprises a retractable coupler in the form of a catch between the setting member and the setting disc, this catch being held in an operative position positively connecting the setting member and disc as long as the fuse is not set, and being retractable to disconnect the setting member and disc only when the fuse is set and the projectile is axially accelerated.

In this fuse, a weight supported facing one end of the catch by a leaf spring is adapted to cause pivoting of the catch to disconnect the setting member and disc, after setting, when the projectile is axially accelerated.

It has however been found that if the projectile falls on its base, after setting, the weight may cause pivoting of the catch and cause a premature disconnection of the setting member and disc. If this happens, it is no longer possible to reset the fuse at the firing site, since the setting member and disc cannot be connected together again without dismantling the setting member.

An aim of the invention is to provide a fuse which is not subject to this drawback.

According to this invention a time fuse suitable for a non-spinning projectile comprises a fuse body, a fuse setting member movable angularly with respect to the fuse body, a fuse setting disc rotationally rigid with a spindle subjected to the torque of a clockwork drive spring adapted to be wound by the setting member, a catch adapted to connect the setting member and the setting disc, and means for acting on the catch to disconnect the setting member and the setting disc in response to axial acceleration when the fuse is set and the projectile carrying the fuse is shot, said means comprising a plunger adapted to cooperate with the catch, said plunger being slidably mounted in a first housing of the setting member having an axis substantially parallel to the axis of the fuse, said plunger having therein a second housing coaxial to the first housing, an inertia block mounted in the second housing for movement towards the catch against the action of a biasing spring, at least one radial opening in the wall of the second housing, said opening facing a recess in the inner face of the wall of the first housing, at least a part of the wall of said recess located nearest the catch being inclined in the direction of the catch, and a movable part held by the inertia block in the radial opening of the wall of the second housing and in the recess in the inner face of the wall of the first housing to lock the plunger relative to the setting member as long as the inertia block is not displaced against the action of the biasing spring by an axial acceleration of the projectile such that it frees the inner end of the radial opening of the wall of the second housing and allows the movable part to move out of the recess in the inner face of the first housing.

The accompanying drawings show, schematically and by way of example, an embodiment of a fuse according to the invention, and a variation. In the drawings.

Figure 1:
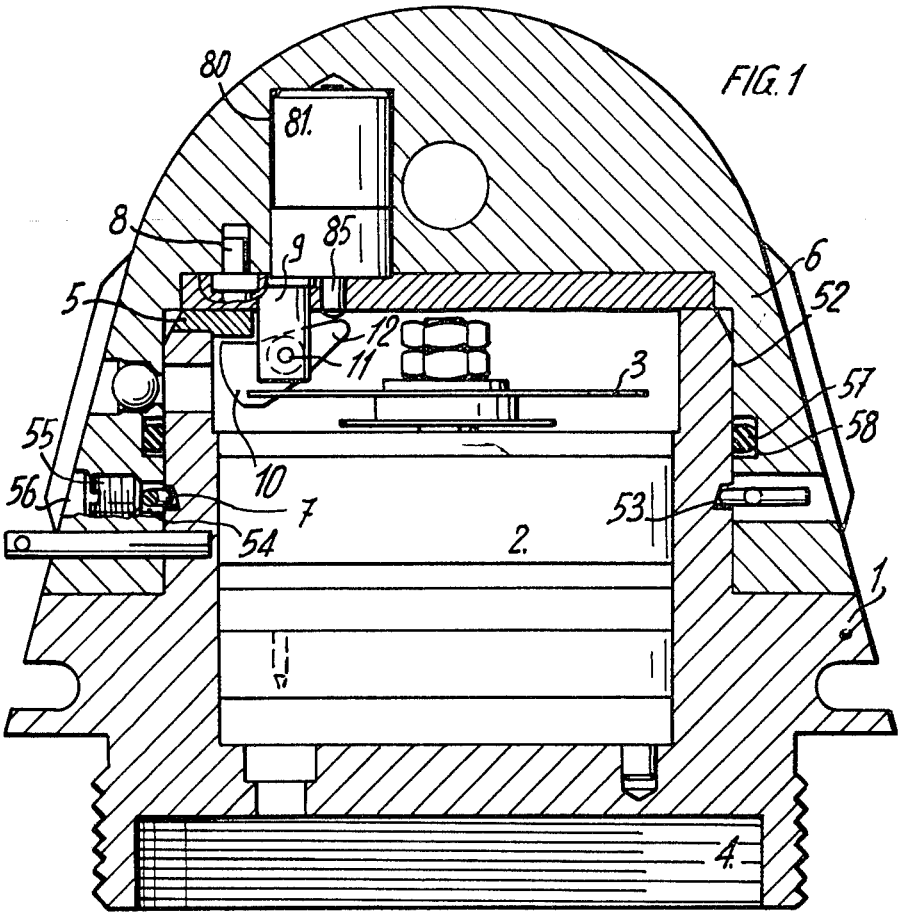
FIG. 1 is an overall view of the fuse partially in axial cross-section.
Figure 2:
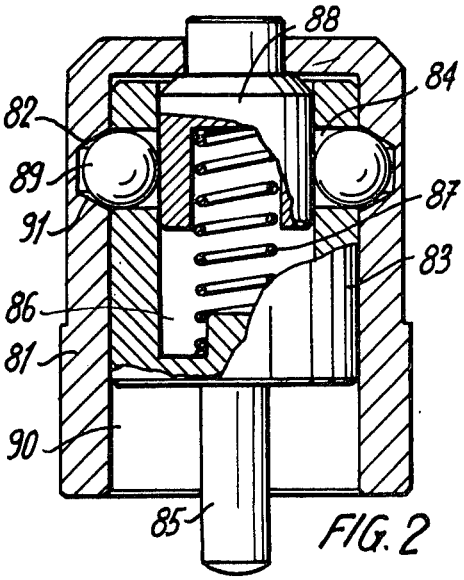
FIG. 2 is an enlarged-scale cut-away view of the plunger partially in axial cross-section.

The mechanical time fuse shown in the drawing is particularly suitable for mounting in non-spinning projectiles, and belongs to the category of fuses that incorporate means for making the projectile transport safe, bore safe, and trajectory safe. The fuse comprises a body 1 in which a clockwork, or time mechanism, indicated generally by the reference number 2, is mounted. This clockwork is wound up by a fuse setting disc 3. The lower part of the fuse body 1 incorporates a threaded hole 4 for a detonator, not shown. A stop 5 is fixed at the top of the fuse body 1, of which the upper part embodies a cylindrical projection 52 that mounts a cap 6 forming part of the ogive of the projectile. The cap 6 is angularly movable with respect to the fuse body 1, and is held axially to the latter by a steel wire 7 which is bent zigzag so that it partly occupies a groove 53 of the fuse body 1 and partly a groove 54 in the cap 6. A screw 55 in a threaded hole 56, extending radially into the cap 6, holds the wire 7 in its active position, for keeping the cap 6 axially in place. An O-ring gasket 57 is held in a groove 58 of the cap 6. The cap 6 also has a stop 8 which cooperates with the stop 5 to limit the angular movement relative to body 1 of the cap 6 between the one side of the stop 5, corresponding to the minimum fuse setting, and the other side, corresponding to the maximum setting.

The cap 6 carries a split pin 9 mounting a catch, or coupled, 10 that is free to pivot about a pin 11 transversely held in the pin 9.

Facing an end 12 of catch 10, cap 6 has a generally cylindrical bore 80 whose axis is parallel to the axis of cap 6. A socket 81 fixed in bore 80 has in the inner face of its cylindrical wall a transverse groove 82 of generally trapezoidal cross-section. A plunger 83 is engaged in the bore 90 of socket 81 and has two diametrically opposite radial bores 84 facing groove 82. The plunger 83 is extended at one end by a rod 85 extending towards the end 12 of catch 10, and its other end is provided with a blind axial housing 86 in which an inertia block 88 is engaged against the action of a compression spring 87. Two balls 89 are each engaged simultaneously in the trapezoidal groove 82 of socket 81 and in a respective one of bores 84 of plunger 83, and are held in this position by the inertia block 88 which, at rest, obturates bores 84.

The fuse also comprises a movable primer support, a firing pin, and an inertial safety mechanism, not shown, adapted, as described in U.S. Pat. No. 3,616,756, to cooperate with the clockwork 2.

Before setting, the catch 10 in the position shown in FIG. 1 engages in a groove in setting disc 3. The catch 10 is prevented from pivoting about pin 11 by stop 5.

The fuse is set by turning cap 6 against an amount of friction sufficient to ensure that the cap is held stably in any angular position relative to body 1. During this setting movement of cap 6, the setting disc 3 is rotated by means of pin 9 and catch 10, the catch 10 thus being moved away from stop 5.

At the moment when the projectile is fired, as a result of the axial acceleration of the projectile in the piece of ordnance, the inertia block 88 is displaced against the action of spring 87. As soon as the inertia block 88 no longer obturates bores 84 of plunger 83, the balls 89 move out of groove 82 of socket 81. The plunger 83 is thus unlocked and is also displaced, whereby the plunger rod 85 causes catch 10 to pivot and the setting disc 3 is thus freed.

The force of spring 87 is chosen so that, in the event of a set projectile falling on its base, the movement of inertia block 88 in insufficient to free the inner ends of bores 84 and to permit balls 89 to leave groove 82 and thus unlock plunger 83 and its rod 85.

Figure 3:
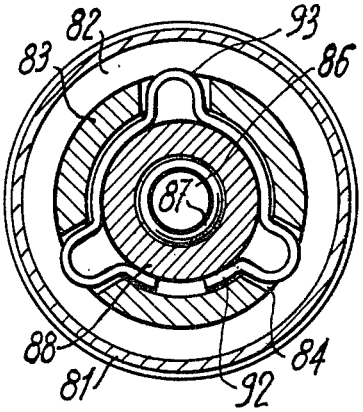
FIG. 3 is a view of a varied form of the plunger of FIG. 2, in transverse cross-section.

In the variation shown in FIG. 3, the balls 89 are replaced by a spring 92 in the form of a split ring having bent projections 93 engaging in three symmetrically disposed bores 84 of plunger 83 and in groove 82 of socket 81. Spring 92 is held under tension by the cylindrical wall of inertia block 88 to hold the projections 93 in groove 82.

When the inertia block 88 is pushed back at the moment of firing the projectile as a result of the axial acceleration of the projectile in the piece of ordnance, it frees spring 92 which relaxes. The projections 93 thus move radially inwardly by an amount which retracts them from groove 82 of socket 81. The plunger 83 is hence freed and is pushed back whereby its rod 85 pivots catch 10 to free the setting disc 3.

Numerous other variations of the described and illustrated embodiment of fuse can be envisaged.

The balls 89 could, for example, be replaced by other forms of movable parts such as pins, rollers or discs with which, generally speaking, the part projecting in groove 82 is arcuate seen in cross-section in a plane passing through the axis of plunger 83. In the latter case, the bores 84 of plunger 83 would be replaced by openings in the form of slots disposed in planes passing through the axis of the plunger.

The groove 82 of trapezoidal cross-section could be replaced by another form of recess in the internal wall of socket 81 having a wall 91 nearest catch 10 inclined towards catch 10 to enable the balls 89 or other movable parts for locking plunger 83 to move out of this recess when the inertia block 88 is displaced.

We claim:

1. In a time fuse suitable for a non-spinning projectile comprising a fuse body, a fuse setting member movable angularly with respect to the fuse body, a spindle subjected to the torque of a clockwork drive spring adapted to be wound by the setting member, a fuse setting disc rotationally rigid with said spindle, a catch connecting the setting member and the setting disc, and means carried by said fuse setting member for acting on the catch to disconnect the setting member and the setting disc in response to axial acceleration when the fuse is set and the projectile carrying the fuse is shot, the improvement wherein said means comprises a plunger including an extension cooperating with the catch, a socket mounted in the setting member and including a first housing, said socket and housing having an axis substantially parallel to the axis of the fuse, said plunger being slidably mounted in said first housing, means defining a second housing in the plunger coaxial to said first housing, an inertia block mounted in said second housing for movement towards the catch, a biasing spring in said second housing, said spring being of sufficient force to normally urge said inertia block away from said catch and prevent accidental release thereof, means defining at least one radial opening in said second housing, means defining a recess in the inner face of said first housing, said opening facing said recess, at least a part of the face of said recess located nearest the catch being inclined in the direction of the catch, a movable part held by the inertia block in said radial opening of said second housing and in said recess in the inner face of said first housing to lock the plunger relative to the setting member as long as the inertia block is not displaced against the action of said biasing spring by an axial acceleration of the projectile, said movable part comprising a projection on a spring in the form of a split ring, said spring held under tension by said inertia block to engage said projection in said radial opening of said second housing and in said recess in the inner face of said first housing, whereby upon such axial acceleration of the projectile, the resulting inertia causes said inertia block to overcome the force of said spring and slide rearwardly in the housing freeing said movable part from said recess and carrying said movable part and said plunger rearwardly with it causing the extension of said plunger to actuate catch (10) to disconnect said setting member and said setting disc and lock said inertia block in its retracted position in said plunger.

* * * * *